US005172069A

United States Patent [19]

Yamamoto

[11] Patent Number: 5,172,069

[45] Date of Patent: Dec. 15, 1992

[54] SECONDARY ELECTRON MULTIPLYING APPARATUS

[75] Inventor: Hiroshi Yamamoto, Kyoto, Japan

[73] Assignee: Murata Manufacturing Co., Ltd., Japan

[21] Appl. No.: 577,908

[22] Filed: Sep. 5, 1990

[30] Foreign Application Priority Data

Sep. 5, 1989 [JP] Japan ..... 1-229963
Sep. 8, 1989 [JP] Japan ..... 1-233850
Sep. 14, 1989 [JP] Japan ..... 1-239649

[51] Int. Cl.[5] ..... H01J 43/00; H01J 43/04; H01J 43/28

[52] U.S. Cl. ..... 328/242; 315/12.1; 328/243

[58] Field of Search ..... 328/242, 243; 315/10, 315/11, 12.1

[56] References Cited

U.S. PATENT DOCUMENTS 2,141,322 12/1938 Thompson ..... 328/243
2,185,172 1/1940 Brüche et al. ..... 328/243
2,220,452 11/1940 Jarvis et al. ..... 328/242
2,346,952 4/1944 Van Mierlo ..... 328/243
2,841,729 7/1958 Wiley ..... 328/243
3,235,765 2/1966 Goodrich et al. .
3,278,751 10/1966 Chubb ..... 328/243
3,436,590 4/1969 Wolfgang et al. .

FOREIGN PATENT DOCUMENTS 50-16145 6/1975 Japan .
50-25303 8/1975 Japan .
52-38378 9/1977 Japan .
876472 9/1961 United Kingdom .
1172304 11/1969 United Kingdom .
1271284 4/1972 United Kingdom .
1276191 6/1972 United Kingdom .
1361006 7/1974 United Kingdom .
2080016 1/1982 United Kingdom .

*Primary Examiner*—John Zazworsky
*Attorney, Agent, or Firm*—Ostrolenk, Faber, Gerb & Soffen

[57] ABSTRACT

There is disclosed a secondary electron multiplying apparatus including a first channel base for multiplying secondary electrons and a second channel base for inducing an inclined electric field. In the secondary electron multiplying apparatus, the second channel base is arranged so that an inner surface thereof opposes an inner surface of the first channel base, thereby forming a channel for moving the secondary electrons in a direction of the inclined electric field from an entrance end of the channel toward an exit end thereof. The inner surface of the first channel base is made of an electrically resistive material having a predetermined relatively large secondary electron emission coefficient, and the inner surface of the second channel base is made of an electrically resistive material having a predetermined secondary electron emission coefficient smaller than that of the inner surface of the first channel base. Further, a collector electrode for collecting the multiplied secondary electrons going out from the channel is arranged so as to oppose the exit end of the channel.

9 Claims, 8 Drawing Sheets

SECONDARY ELECTRON MULTIPLYING APPARATUS

BACKGROUND OF THE INVENTION

1. Field Of The Invention

The present invention relates to a secondary electron multiplying apparatus, and more particularly, to a secondary electron multiplying apparatus having a high multiplying gain which is capable of preventing the ion feed back phenomenon.

2. Description Of The Related Art

Conventionally, there have been provided a secondary electron multiplying apparatus comprising plural separate dinodes for multiplying secondary electrons, and a continuous dinode type secondary electron multiplying apparatus comprising continuous multiplying channel for multiplying secondary electrons, which is also called a channel type secondary electron multiplying apparatus. The continuous dinode type secondary electron multiplying apparatus comprises a channel formed between plate-shaped channel bases arranged in parallel so as to oppose to each other or a pipe-shaped channel, and an emission surface for emitting secondary electrons having a high electrical resistance which is provided on an inner surface of the channel.

FIG. 1 shows a conventional continuous dinode type secondary electron multiplying apparatus 1.

Referring to FIG. 1, the continuous dinode type secondary electron multiplying apparatus 1 comprises secondary electron emission surfaces 4 and 5 of a high electrically resistive material capable of emitting secondary electrons, which are formed on respective opposing surfaces of plate-shaped channel bases 2 and 3 of glass or ceramics arranged so as to be parallel to each other, and then, there is formed a channel 6 having an entrance end 7 and an exit end 8 between the secondary electron emission surfaces 4 and 5.

A direct-current high voltage source 9 is electrically connected between the entrance end 7 and the exit end 8 of the channel 6 in order to apply an electric field for accelerating secondary electrons emitted from the secondary electron emission surfaces 4 and 5 in the axis direction of the channel 6. Further, there is arranged a collector electrode 11 for collecting secondary electrons multiplied within the channel 6 so as to oppose the exit end 8 of the channel 6. A direct-current voltage source 12 is electrically connected between the collector electrode 11 and the exit end 8 of the channel 6 in order to apply an electric field for leading the multiplied secondary electrons going out from the exit end 8 to the collector electrode 11.

In the secondary electron multiplying apparatus 1 constructed as described above, when primary electrons 13 are incident to the channel 6 from the side of the entrance end 7 thereof as indicated by solid lines in FIG. 1, the primary electrons 13 bombard the secondary electron emission surfaces 4 and 5, and then, secondary electrons are emitted therefrom. The emitted secondary electrons are accelerated by the above-mentioned electric field applied by the high voltage source 9, and further bombard the secondary electron emission surfaces 4 and 5, following a parabolic trajectory. Furthermore, additional secondary electrons are emitted therefrom. The above process is repeated so that the secondary electrons are multiplied in the channel 6, and the multiplied secondary electrons are collected onto the collector electrode 11.

In the channel 6 of the secondary electron multiplying apparatus 1, equipotential surfaces are formed so as to be perpendicular to the axis direction of the channel 6 as shown by dotted lines in FIG. 1. Therefore, the trajectory of the secondary electrons drawn in the channel 6 have parabolic shapes, and the number of the bombardment of the secondary electrons with the secondary electron emission surfaces 4 and 5 is in proportion to the ratio of the distance in the axis direction of the channel 6 to the distance between the channel bases 2 and 3. Accordingly, in order to heighten the gain of the secondary electron multiplying apparatus 1, it is necessary to increase the above-mentioned ratio. Further, it is necessary to form the equipotential surfaces in parallel so as to be perpendicular to the axis direction of the channel 6, and to further increase the length of the axis thereof.

In order to solve the above-mentioned problems of the conventional continuous dinode type secondary electron multiplying apparatus 1, there was proposed an inclined electric field type secondary electron multiplying apparatus capable of obtaining a high multiplying gain at a low acceleration voltage by utilizing an inclined electric field for accelerating secondary electrons in the Japanese patent examined publication (JP-B2) No. 50-16145/1975, the Japanese patent examined publication (JP-B2) No. 50-25303/1975, the Japanese patent examined publication (JP-B2) No. 52-38378/1977, and the U.S. Pat. No. 3,235,765 etc..

FIGS. 2 and 3 show secondary electron multiplying apparatuses 24 and 25 disclosed in the Japanese patent examined publication (JP-B2) No. 50-25303/1975.

Referring to FIGS. 2 and 3, in the secondary electron multiplying apparatuses 24 and 25, there are arranged a first plate 21 comprising an inner surface capable of emitting secondary electrons and a second plate 22 of a high electrically resistive material or an electrically conductive material to form a channel 23 having an entrance end **23*a* and an exit end 23*b* so that the interval between the first and second plates 21 and 22 is enlarged as approaching the exit end 23*b* of the channel 23. Then, equipotential surfaces formed between the first and second plates 21 and 22 which are indicated by dotted lines in FIGS. 2 and 3 cross the first plate 21 at an acute angle, and the potentials of the equipotential surfaces become higher as approaching the exit end 23*b*. Therefore, the secondary electrons bombard a secondary electron multiplying surface 26 of the first plate 21, drawing loci as indicated by real lines in FIGS. 2 and 3, and are multiplied. Finally, the multiplied secondary electrons are collected onto a collector electrode 27**.

In the above-mentioned conventional secondary electron multiplying apparatuses 24 and 25, the interval between the first and second plates 21 and 22 is narrowed on the side of the entrance end **23*a* of the channel 23, and is enlarged approaching the exit end 23*b* thereof. Therefore, in order to make charged particles be incident into the channel 23 from the side of the entrance end 23*a*** thereof, it is necessary to taper down a beam of charged particles to be incident thereto as soon as possible.

A further problem is that in a general secondary electron multiplying apparatus, since the density of the electrons is high at the exit end **23*b* of the channel 23 because of multiplying the secondary electrons, the electrons collide with a remaining gas, and the remaining gas is ionized so as to become ions having a polarity opposite to that of the electrons. In the above-mentioned conventional secondary electron multiplying apparatuses 24 and 25, since the interval between the first and second plates 21 and 22 is enlarged on the side of the exit end 23***b* of the channel 3, there is caused the problem of the so-called ion feed back phenomenon wherein the above-mentioned ions going out from the channel 23 are returned to the channel 23, and bombard the second plate 22 so as to emit secondary electrons.

Further, there has been proposed a disk like shape type secondary electron multiplying apparatus capable of multiplying secondary electrons when the secondary electrons extend radially outward from the center thereof toward the outer edge thereof.

FIG. 4*a* is a schematic top plan view showing a structure of the conventional disk like shape type secondary electron multiplying apparatus 51 disclosed in U.S. Pat. No. 3,436,590, and FIG. 4*b* is a schematic cross sectional view taken on a line IVb- IVb' of FIG. 4*a* of the disk like shape type secondary electron multiplying apparatus 51.

Referring to FIGS. 4*a* and 4*b*, the disk like shape type secondary electron multiplying apparatus 51 comprises two circular plates 52 and 53. Grooves 54*a* to 54*e* are formed in a shape of concentric circles on the inner surface of the circular plate 52 so that each groove shown in the cross section of FIG. 4*b* has a shape of a circular arc and the radius of curvature thereof is gradually enlarged away from the center of the circular plate 52. On the inner surfaces of respective grooves 54*a* to 54*d* except for the outermost groove 54*e*, there is formed an electrically conductive layer 71 and a secondary electron emissive layer 55 of a material having a relatively large secondary electron emission coefficient. Further, a collector electrode 56 is formed on the inner surface of the outermost groove 54*e* so as to be electrically connected to the conductive layer 71.

On the other hand, there is formed a concave 57 in the circular plate 53 on the side of the inner surface of the circular plate 53 which opposes the inner surface of the circular plate 52, and grooves 58*a* to 58*e* are formed at respective positions shifted by half a groove width from those of respective grooves 54*a* to 54*e* in the radial direction on the surface of the concave 57 which opposes the inner surface of the circular plate 52. Further, there are formed an electrically conductive layer 72 and a secondary electron emissive layer 59 of a material having a relatively large secondary electron emission coefficient on the inner surfaces of respective grooves 58*a* to 58*e*.

The above-mentioned two circular plates 52 and 53 are overlapped and fixed integrally on each other so that the inner surfaces thereof oppose each other, so that a channel 70 is formed between the circular plates 52 and 53. A direct-current high voltage source 63 is electrically connected between a terminal 61 provided in the center of the circular plate 52 which is electrically connected to the secondary electron emissive layer 55 through the conductive layer 71, and a high voltage terminal 62 which is electrically connected to the secondary electron emissive layer 55 formed on the groove 54*d* through the conductive layer 71. On the other hand, a direct-current high voltage source 66 is electrically connected between a terminal 64 provided in the center of the circular plate 53 which is electrically connected to the secondary electron emissive layer 59 through the conductive layer 72, and a high voltage terminal 65 which is electrically connected to the secondary electron emissive layer 59 formed on the groove 58*e* through the conductive layer 72. Thus, there is applied an accelerating electric field in the radial direction, namely, in the direction from the center of each of the circular plates 52 and 53 to the outer edge thereof. Furthermore, a direct-current voltage source 68 is connected between the above-mentioned high voltage terminal 65 and a collector terminal 67 which is electrically connected to the collector electrode 56 through the collector terminal 67. A coupling capacitor Cc is also connected to the collector terminal 67.

When charged particles are incident into the channel 70 from an entrance hole 69 formed in the center of the circular plate 52, they bombard the secondary electron emissive layer 59 formed on the circular plate 53, and then, secondary electrons are emitted therefrom. Thereafter, the emitted secondary electrons are multiplied bombarding the secondary electron emissive layers 55 and 59 by an electric force of the above-mentioned accelerating electric field, and finally, the multiplied secondary electrons are taken out as a secondary electron current from the collector electrode 56.

In the above-mentioned disk like shape type secondary electron multiplying apparatus 51, a problem is that it is difficult to form the grooves 54*a* to 54*e* and 58*a* to 58*e* respectively having the above-mentioned particular shapes and also to form the secondary electron emissive layers 55 and 59 with a high precision. Therefore, the disk like shape type secondary electron multiplying apparatus has not yet been put into practical use, actually.

SUMMARY OF THE INVENTION

An essential object of the present invention is to provide an inclined electric field type secondary electron multiplying apparatus capable of preventing the above-mentioned ion feed back phenomenon.

Another object of the present invention is to provide an inclined electric field type secondary electron multiplying apparatus capable of obtaining a high multiplying gain, and operating stably even in a low vacuum.

A further object of the present invention is to provide a disk like shape type secondary electron multiplying apparatus having a simple structure so as to be made simply, and capable of preventing the above-mentioned ion feed back phenomenon, obtaining a high multiplying gain, and operating stably even in a low vacuum.

In order to accomplish the above objects, according to one aspect of the present invention, there is provided a secondary electron multiplying apparatus comprising:

a plate-shaped first channel base for multiplying secondary electrons having an entrance electrode formed on one end thereof and an exit electrode formed on another end thereof;

a plate-shaped second channel base for inducing an inclined electric field having an entrance electrode formed on one end thereof and an exit electrode formed on another end thereof, said second channel base being arranged so that an inner surface thereof opposes to an inner surface of said first channel base, thereby forming a channel for moving said secondary electrons in a direction of said inclined electric field from an entrance end of said channel toward an exit end thereof;

said inner surface of said first channel base being made of an electrically resistive material having a predetermined relatively large secondary electron emission coefficient; said inner surface of said second channel base being made of an electrically resistive material having a predetermined secondary electron emission coefficient smaller than that of said inner surface of said first channel base;

a collector electrode for collecting said multiplied secondary electrons going out from said channel, said collector electrode being arranged so as to oppose to said exit end of said channel;

a first voltage source for applying a predetermined direct-current high voltage between said entrance electrodes of said first and second channel bases and said exit electrodes thereof; and a second voltage source for applying a predetermined direct-current voltage between said exit electrodes of said first and second channel bases and said collector electrode.

According to another aspect of the present invention, there is provided a secondary electron multiplying apparatus comprising:

a plate-shaped first channel base for multiplying secondary electrons having an entrance electrode formed on one end thereof and an exit electrode formed on another end thereof;

a plate-shaped second channel base for inducing an inclined electric field having an entrance electrode formed on one end thereof and an exit electrode formed on another end thereof, said second channel base being arranged so that an inner surface thereof opposes to an inner surface of said first channel base and the interval between respective one ends of said first and second channel bases is larger than that between respective another ends thereof, thereby forming a channel for moving said secondary electrons in a direction of said inclined electric field from an entrance end of said channel toward an exit end thereof;

said inner surface of said first channel base being made of an electrically resistive material having a predetermined relatively large secondary electron emission coefficient; said inner surface of said second channel base being made of an electrically resistive material having a predetermined secondary electron emission coefficient;

a collector electrode for collecting said multiplied secondary electrons going out from said channel, said collector electrode being arranged so as to oppose to said exit end of said channel;

a first voltage source for applying a predetermined direct-current high voltage between said entrance electrodes of said first and second channel bases and said exit electrodes thereof; and a second voltage source for applying a predetermined direct-current voltage between said exit electrodes of said first and second channel bases and said collector electrode, thereby inducing said electric field inclined to said inner surface of said first channel base.

According to a further aspect of the present invention, there is provided a secondary electron multiplying apparatus comprising:

a circular plate-shaped first channel base for multiplying secondary electrons having an entrance electrode formed in the center thereof and an exit electrode formed on the outer peripheral edge thereof so as to extend toward said entrance electrode by a predetermined longitudinal length;

a circular plate-shaped second channel base for inducing an inclined electric field having an incidence hole for passing primary electrons therethrough which is formed in the center thereof, an entrance electrode formed on the inner surface of said incidence hole and an exit electrode formed on the outer peripheral surface thereof, said second channel base being arranged so that an inner surface thereof opposes to an inner surface of said first channel base, thereby forming a channel for moving said secondary electrons in a direction of said inclined electric field from an entrance center of said channel toward an exit outer peripheral end thereof;

said inner surface of said first channel base being made of an electrically resistive material having a predetermined relatively large secondary electron emission coefficient; said inner surface of said second channel base being made of an electrically resistive material having a predetermined secondary electron emission coefficient;

a collector electrode for collecting said multiplied secondary electrons going out from said channel, said collector electrode being arranged so as to oppose to said exit outer peripheral end of said channel;

a first voltage source for applying a predetermined direct-current high voltage between said entrance electrode of said first channel base and said exit electrode thereof;

a second voltage source for applying a predetermined direct-current high voltage between said entrance electrode of said second channel base and said exit electrode thereof; and a third voltage source for applying a predetermined direct-current voltage between said exit electrode of said first channel base and said collector electrode, thereby inducing said electric field inclined to said inner surface of said first channel base.

BRIEF DESCRIPTION OF THE DRAWINGS

These and other objects and features of the present invention will become clear from the following description of preferred embodiments thereof with reference to the accompanying drawings, in which.

DETAILED DESCRIPTION OF THE PREFERRED EMBODIMENTS

Preferred embodiments according to the present invention will be described below with reference to the attached drawings.

First preferred embodiment

Figure 5:
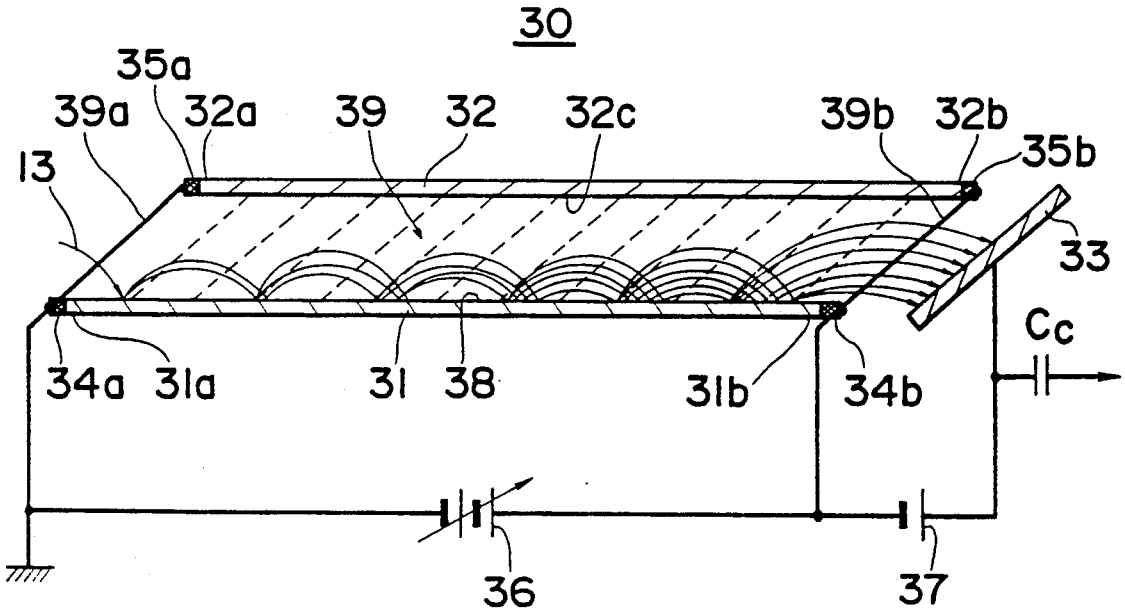
FIG. 5 is a schematic cross sectional view showing a structure of an inclined electric field type secondary electron multiplying apparatus of a first preferred embodiment according to the present invention.

FIG. 5 is a schematic cross sectional view showing a structure of an inclined electric field type secondary electron multiplying apparatus 30 of a first preferred embodiment according to the present invention.

Referring to FIG. 5, the inclined electric field type secondary electron multiplying apparatus 30 of the first preferred embodiment comprises a plate-shaped first channel base 31 for multiplying secondary electrons, and a plate-shaped second channel base 32 for inducing an inclined electric field, which are arranged so as to oppose each other. Each of the first and second channel bases 31 and 32 has substantially the same longitudinal length, however, the second channel base 32 is arranged opposing the first channel base 31 so that one end 32*a* thereof does not oppose one end 31*a* of the first channel base 31 and so as to be shifted by a predetermined distance in a horizontal or longitudinal direction, namely, toward another end 31*b* of the first channel base 31. Thus, there is formed a channel 39 between the first and second channel bases 31 and 32.

The first channel base 31 is made of an electrically resistive material having a relatively large secondary electron emission coefficient so as to emit many secondary electrons when primary electrons bombard there, such as ceramics of $ZnO—TiO_2$ system, and the first channel base 31 has a secondary electron multiplying inner surface 38 thereon.

Further, the second channel base 32 is made of the same material as that of the first channel base 31. However, the inner surface 32*c* of the second channel base 32 opposing to the inner surface 38 of the first channel base 31 is processed so as to be made rough, namely, so as to decrease the secondary electron emission coefficient thereof by the bombardment with ions such as Ar ions. Thus, the secondary electron emission coefficient of the inner surface 32*c* of the second channel base 32 is smaller than that of the inner surface 38 of the first channel base 31.

In order to collect the multiplied secondary electrons going out from an exit end 39*b* of the channel 39 located between the another end 31*b* of the first channel base 31 and the another end 32*b* of the second channel base 32, there is arranged a plate-shaped collector electrode 33 so that the plane thereof becomes parallel to the surface of the exit end 39*b*.

A direct-current high voltage source 36 is electrically connected between an electrode 34*a* formed on one end 31*a* of the first channel base 31 and an electrode 34*b* formed on another end 31*b* thereof, and between an electrode 35*a* formed on one end 32*a* of the second channel base 32 and an electrode 35*b* formed on another end 32*b* thereof so that the electric potential of each of the electrodes 31*b* and 32*b* are higher than that of each of the electrodes 31*a* and 32*a*. Further, a direct-current voltage source 37 is electrically connected between the collector electrode 33 and the electrodes 31*b* and 32*b* so that the electric potential of the collector electrode 33 is higher than that of each of the electrodes 31*b* and 32*b*.

In the inclined electric field type secondary electron multiplying apparatus 30 constructed as described above, since the first and second channel bases 31 and 32 are arranged so as to be shifted from each other in the longitudinal direction as described above, equipotential surfaces are formed in the channel 30 located between the first and second channel bases 31 and 32 as indicated by dotted lines in FIG. 5. Therefore, an inclined electric field is induced in the channel 39 so as to be perpendicular to the equipotential surfaces. When primary electrons are incident into the channel 39 from the side of an entrance end 39*a* located between one end 31*a* of the first channel base 31 and one end 32*a* of the second channel base 32, they bombard the first channel base 31, and then, the secondary electrons are emitted therefrom. In the inclined electric field induced in the channel 39, the emitted secondary electrons move in a movement similar to the cycloid movement, and the bombardment of the secondary electrons with the secondary electron multiplying inner surface 38 is repeated so as to multiply the secondary electrons. Finally, the multiplied secondary electrons are collected onto the collector electrode 33, the secondary electron current is taken out from the collector electrode 33 through a coupling capacitor Cc.

Figure 6:
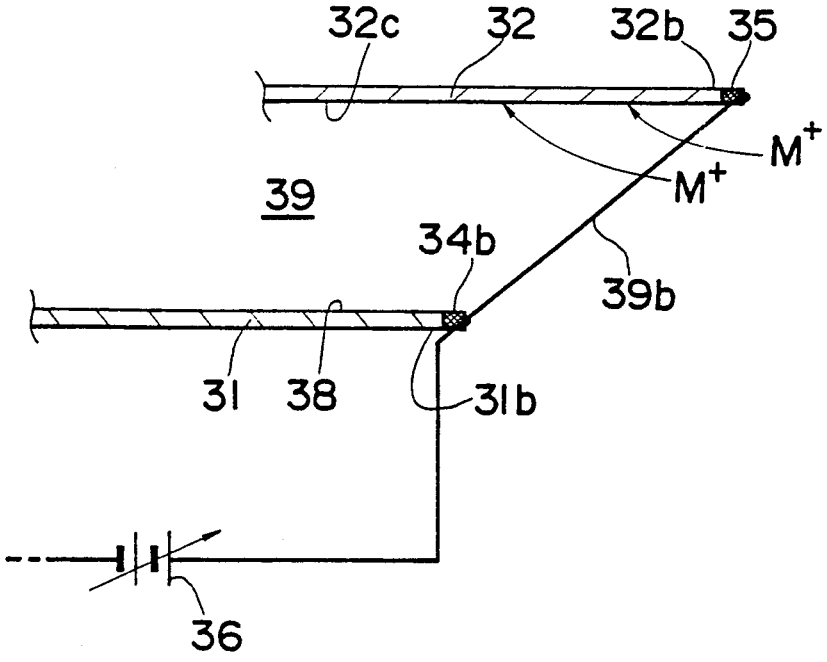
FIG. 6 is an enlarged cross sectional view showing the vicinity of an exit end of of the secondary electron multiplying apparatus shown in FIG. 5.

In the vicinity of the second end 31*b* of the first channel base 31, the density of electrons is very high since the multiplied secondary electrons go out therefrom, and the secondary electrons collide with a remaining gas so that the remaining gas is ionized so as to become ions $M^+$ having a polarity opposite to that of the secondary electrons. Therefore, as shown in FIG. 6, the above-mentioned ions $M^+$ go back into the channel 39 located between the first and second channel bases 31 and 32, and bombard the inner surface 32*c* of the second channel base 32. However, since the second channel base 32 comprises the inner surface 32*c* of the electrically resistive material which is processed so as to decrease the secondary electron emission coefficient thereof, substantially no secondary electron is emitted even though the above-mentioned ions $M^+$ bombard the inner surface 32*c*. Therefore, the ion feed back phenomenon can be prevented. Then, the secondary electron multiplying apparatus 30 operates stably even in a low vacuum, and any noise is prevented from being generated due to the ion feed back phenomenon. Further, there is no suppression effect of the gain due to the space charge, resulting in a large output current.

Figure 7:
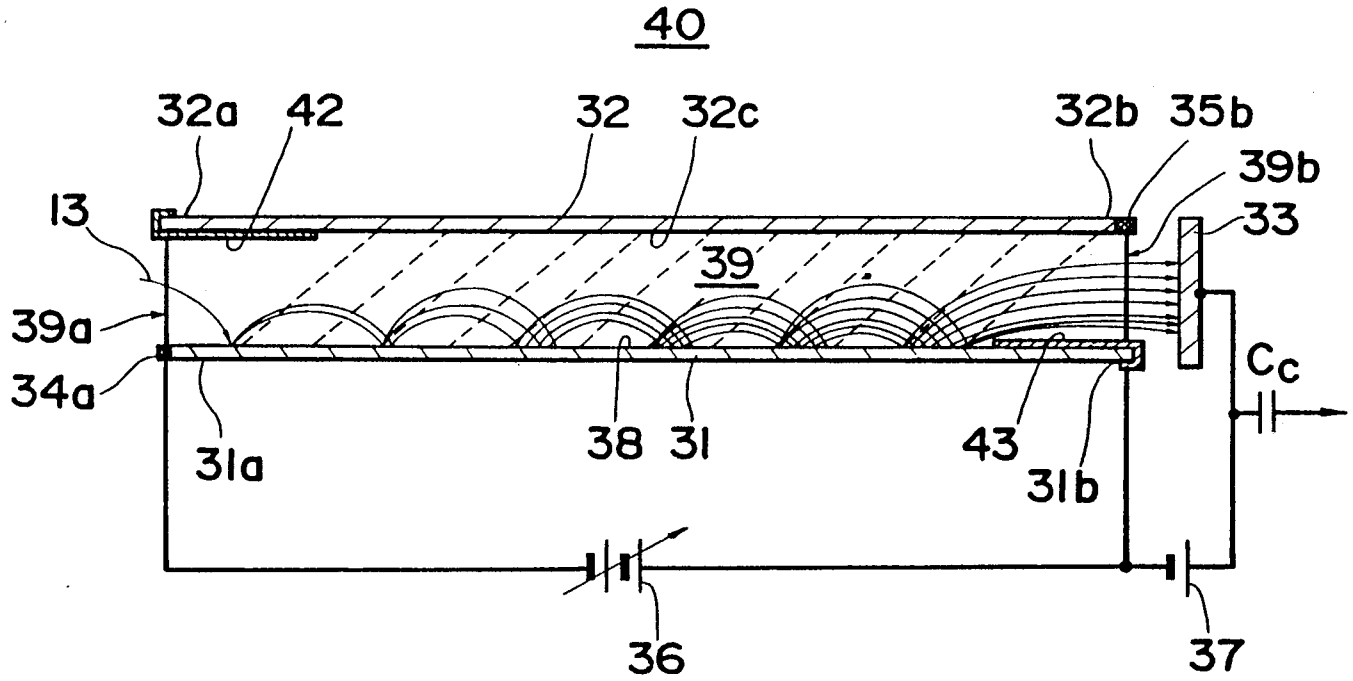
FIG. 7 is a schematic cross sectional view showing a structure of another inclined electric field type secondary electron multiplying apparatus of a modification of the first preferred embodiment.

FIG. 7 is a schematic cross sectional view showing a structure of another inclined electric field type secondary electron multiplying apparatus 40 of a modification of the first preferred embodiment. In FIG. 7, the components corresponding to those shown in FIGS. 5 and 6 are denoted by the same numerals as those shown in FIGS. 5 and 6.

Referring to FIG. 7, the inclined electric field type secondary electron multiplying apparatus 40 comprises the first and second channel bases 31 and 32 arranged so as to oppose to each other and so that one ends 31*a* and 32*a* thereof are positioned at the same position in the horizontal direction and another ends 31*b* and 32*b* thereof are positioned at the same position in the horizontal direction. Further, in order to induce an inclined electric field, an electrode 42 having a predetermined longitudinal length extending in the axis direction or the longitudinal direction of the channel 39 is formed on one end 32*a* of the inner surface 32*c* of the second channel base 32 in place of the electrode 35*a*, and also an electrode 43 having a predetermined longitudinal length extending in the axis direction of the channel 39 is formed on another end 31*b* of the inner surface 38 of the first channel base 31 in place of the electrode 34*b*.

The direct-current voltage source 36 is electrically connected between the electrode 34*a* formed on one end 31*a* of the first channel base 31 and the electrode 43 formed on the another end 31*b* thereof, and between the electrode 42 formed on the one end 32*a* of the second channel base 32 and the electrode 35*b* formed on the another end 32*b* thereof.

In the secondary electron multiplying apparatus 40 constructed as shown in FIG. 7, the electrodes 42 and 43 for inducing an inclined electric field form an equipotential on one end 32*a* of the second channel base 32 on the side of the entrance end 39*a* of the channel 39, and also, form an equipotential on another end 31*b* of the first channel base 31 on the side of the exit end 39*b* thereof. Therefore, in the channel 39, there is induced an inclined electric field due to the equipotential surfaces in a manner similar to that of the secondary electron multiplying apparatus 30 shown in FIG. 5.

Even in the secondary electron multiplying apparatus 40 shown in FIG. 7, since the inner surface 32*c* of the second channel base 32 opposing to the inner surface 38 of the first channel base 31 is processed so as to decrease the secondary electron emission coefficient thereof, there is caused no emission of secondary electrons even though the ions collide with the inner surface 32*c*, and the above-mentioned ion feed back phenomenon can be prevented.

In the first preferred embodiment and the modification thereof, the first and second channel bases 31 and 32 may be made of plate-shaped glass, on the surface of which there is formed a secondary electron emissive layer of a material capable of emitting secondary electrons.

Second preferred embodiment

Figure 8:
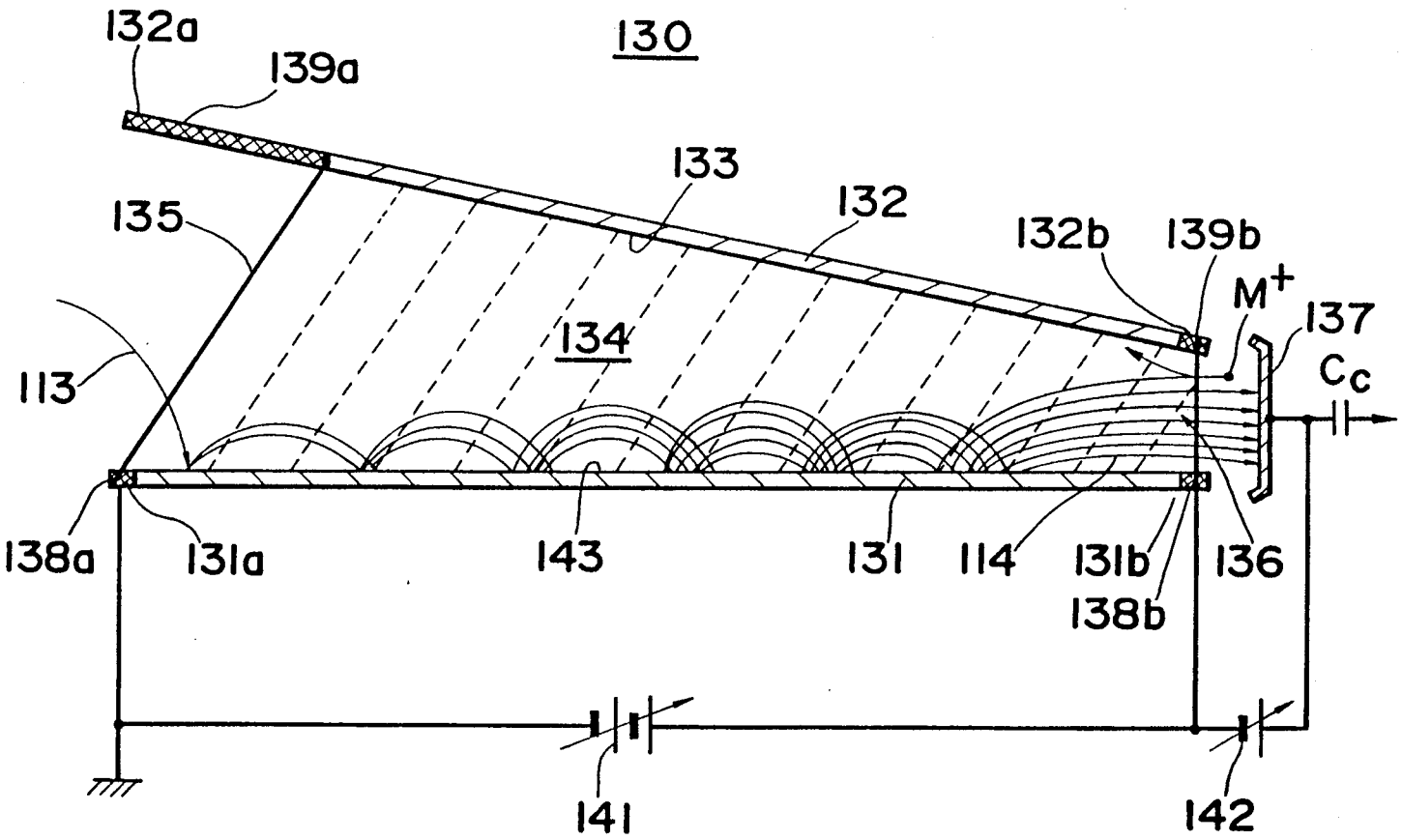
FIG. 8 is a schematic cross sectional view showing a structure of an inclined electric field type secondary electron multiplying apparatus of a second preferred embodiment according to the present invention.

FIG. 8 is a schematic cross sectional view showing a structure of an inclined electric field type secondary electron multiplying apparatus 130 of a second preferred embodiment according to the present invention.

Referring to FIG. 8, the inclined electric field type secondary electron multiplying apparatus 130 of the second preferred embodiment comprises a plate-shaped first channel base 131 for multiplying secondary electrons, and a plate-shaped second channel base 132 for inducing an inclined electric field, which are arranged so that the interval between the first and second channel bases 131 and 132 positioned at an entrance end 135 of a channel 134 formed therebetween is larger than the interval therebetween positioned at an exit end 136 of the channel 134, namely, the interval therebetween becomes small as approaching the exit end 136 thereof, wherein the entrance end 135 is located between one end 131*a* of the first channel base 131 and one end 132*a* of the second channel base 132, and the exit end 136 is located between another end 131*b* of the first channel base 131 and another end 132*b* of the second channel base 132.

The first channel base 131 is made of an electrically resistive material having a relatively large secondary electron emission coefficient so as to emit many secondary electrons when primary electrons bombard there, such as ceramics of $ZnO—TiO_2$ system, and the first channel base 131 has a secondary electron multiplying inner surface 143.

Further, the second channel base 132 is made of the same material as that of the first channel base 131. However, the inner surface 133 of the second channel base 132 opposing to the inner surface 143 of the first channel base 131 is processed so as to be made rough, namely, so as to decrease the secondary electron emission coefficient thereof by the bombardment with ions such as Ar ions. Then, the secondary electron emission coefficient of the inner surface 133 of the second channel base 132 is smaller than that of the inner surface 143 of the first channel base 131.

In order to collect the multiplied secondary electrons going out from the exit end 136 of the channel 134, there is arranged a plate-shaped collector electrode 137 so that the surface thereof opposes to the surface of the exit end 136.

A direct-current high voltage source 141 is electrically connected between an electrode 138*a* formed on one end 131*a* of the first channel base 131 and an electrode 138*b* formed on another end 131*b* thereof, and between an electrode 139*a* formed on one end 132*a* of the second channel base 132 and an electrode 139*b* formed on another end 132*b* thereof so that the electric potential of each of the electrodes 138*b* and 139*b* are higher than that of each of the electrodes 138*a* and 139*a*. Further, a direct-current voltage source 142 is electrically connected between the collector electrode 137 and the electrodes 138*b* and 139*b* so that the electric potential of the collector electrode 137 is higher than that of each of the electrodes 138*b* and 139*b*.

In the secondary electron multiplying apparatus 130 constructed as described above, there is induced a uniform accelerating electric field in the channel 134 by a direct-current voltage applied by the direct-current high voltage source 141. Therefore, virtual surfaces connecting between the same electric potentials of the first and second channel base 131 and 132 become equipotential surfaces, respectively. However, since the first and second channel bases 131 and 132 are arranged so that the height of the channel 134 becomes small as approaching the exit end 136 thereof as described above, the equipotential surfaces are formed so as to cross the inner surface 143 of the first channel base 131 at an acute angle, as indicated by dotted lines in FIG. 8. Accordingly, there is induced an inclined electric field perpendicular to the equipotential surfaces.

When primary electrons 113 are incident into the channel 134 formed between the first and second channel bases 131 and 132 from the side of the entrance end 135 thereof, they bombard the inner surface 143 of the first channel base 131, and then, the secondary electrons are emitted therefrom. In the inclined electric field of the channel 134, the emitted secondary electrons move in a movement similar to the cycloid movement, and the bombardment of the secondary electrons with the secondary electron multiplying inner surface 143 of the first channel base 131 is repeated so as to multiply the secondary electrons. Finally, the multiplied secondary electrons are collected onto the collector electrode 137, the secondary electron current is taken out from the collector electrode 137 through a coupling capacitor Cc.

In the vicinity of the another end 131*b* of the first channel base 131, the density of electrons is very high since the multiplied secondary electrons go out therefrom, and the secondary electrons collide with a remaining gas so that the remaining gas is ionized so as to become ions M+ having a polarity opposite to that of the secondary electrons. Therefore, as shown in FIG. 8, the above-mentioned ions M+ may enter the channel 134 located between the first and second channel bases 131 and 132. However, since the height of the channel 134 positioned at the exit end 136 thereof is very small, the possibility of the ions' entering the channel 134 is very small. Even though the above-mentioned ions M+ go back from the exit end 136 of the channel 134 into the channel 134 and bombard the inner surface 133 of the second channel base 132, substantially no secondary electron 114 is emitted therefrom since the inner surface 133 of the second channel base 132 is processed so as to have a secondary electron emission coefficient smaller than that of the inner surface 143 of the first channel base 131, resulting in preventing the above-mentioned ion feed back phenomenon. Then, the secondary electron multiplying apparatus 130 operates stably even in a low vacuum, and any noise is prevented from being generated due to the ion feed back phenomenon. Further, there is no suppression effect of the gain due to the space charge, resulting in a large output current.

Furthermore, since the entrance end 135 of the channel is relatively wide, it is not necessary to taper down a beam of incident primary electrons.

Figure 9:
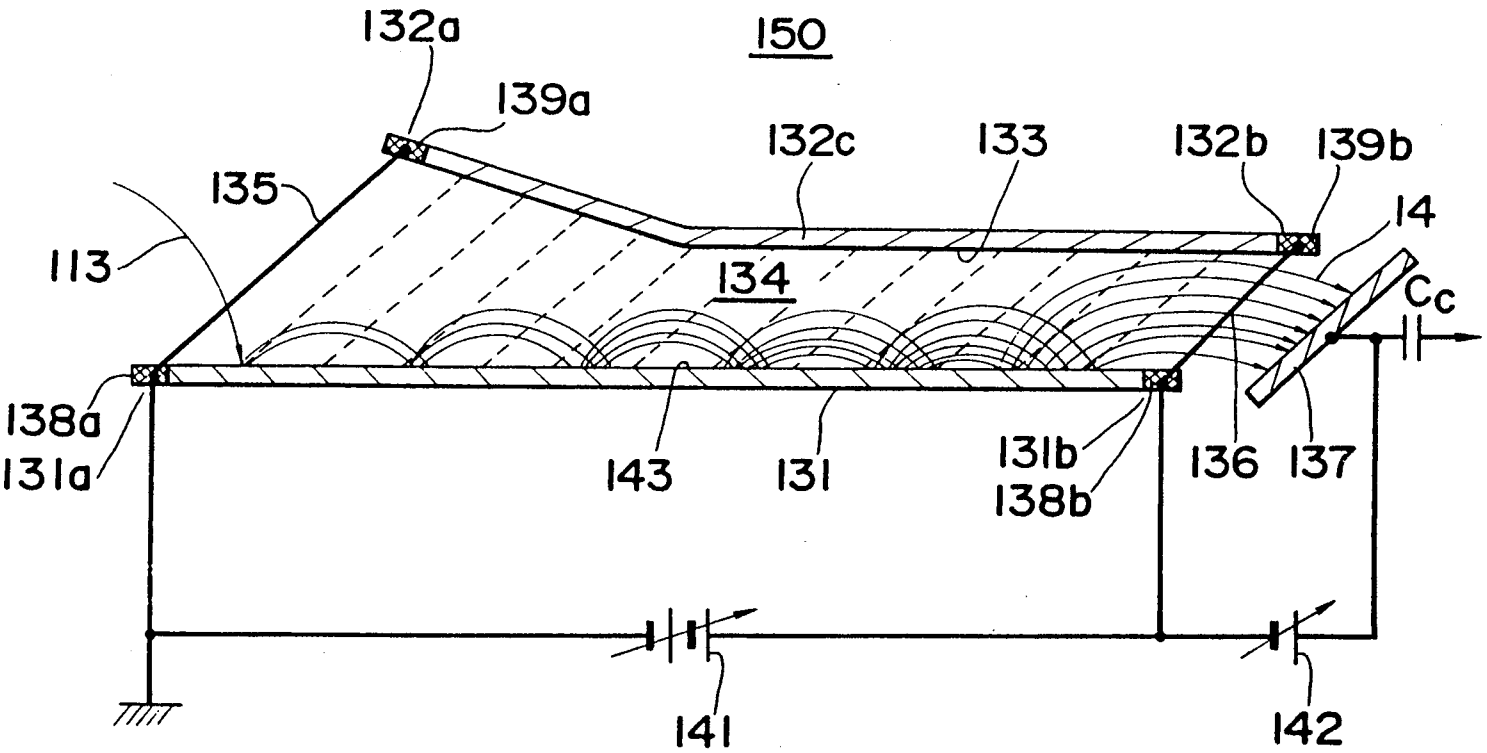
FIG. 9 is a schematic cross sectional view showing a structure of another inclined electric field type secondary electron multiplying apparatus of a modification of the second preferred embodiment.

FIG. 9 is a schematic cross sectional view showing a structure of another inclined electric field type secondary electron multiplying apparatus 150 of a modification of the second preferred embodiment. In FIG. 9, the components corresponding to those shown in FIG. 8 are denoted by the same numerals as those shown in FIG. 8.

Referring to FIG. 9, as compared with the inclined electric field type secondary electron multiplying apparatus 130 shown FIG. 8, the inclined electric field type secondary electron multiplying apparatus 150 is characterized in that an second channel base 132*c* is arranged opposing the first channel base 131 so that one end 132*a* thereof does not oppose to one end 131*a* of the first channel base 131 and so as to be shifted by a predetermined distance in a horizontal or longitudinal direction, namely, toward another end 131*b* of the first channel base 131, and also the approximately middle portion of the second channel base 132 is folded toward the outside thereof by a predetermined angle such as an angle in the range from about 5° to about 30° so that the interval between the first and second channel bases 131 and 132 at the entrance end 135 of the channel 134 becomes larger than that at the exit end 136 thereof.

The inclined electric field type secondary electron multiplying apparatus 150 constructed as described above also has the action and the effect similar to those of the secondary electron multiplying apparatus 130 shown in FIG. 8.

In the second preferred embodiment and the modification thereof, the first and second channel bases 131 and 132 or 132*c* may be made of plate-shaped glass or plate-shaped ceramics, on the surface of which a secondary electron emissive layer of a material capable of emitting secondary electrons is formed by the sputtering method or the vapor deposition method etc..

Third preferred embodiment

Figure 10A:
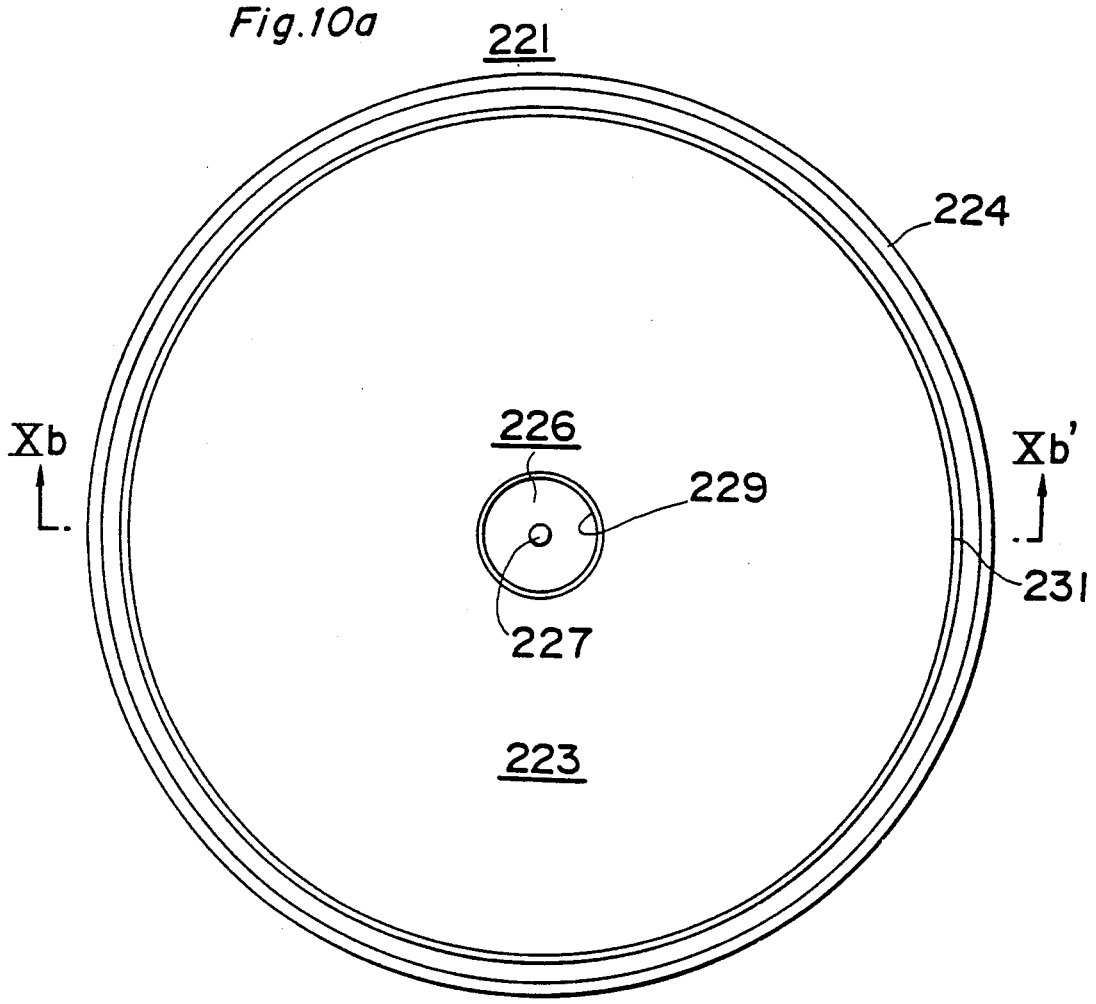
FIG. 10*a* is a schematic top plan view showing a structure of a disk like shape type secondary electron multiplying apparatus of a third preferred embodiment according to the present invention.
Figure 10B:
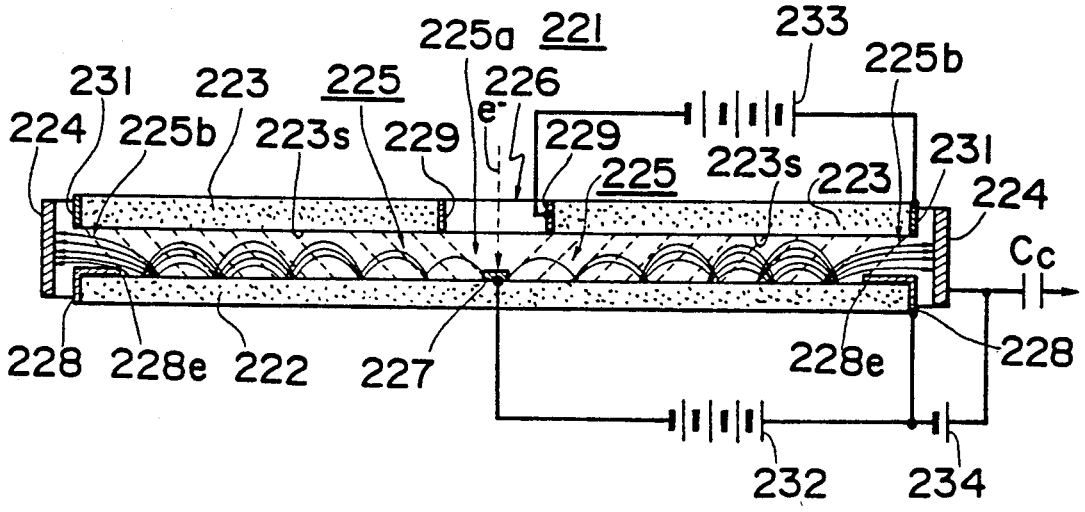
FIG. 10*b* is a schematic cross sectional view taken on a line Xb-Xb' of FIG. 10*a* of the disk like shape type secondary electron multiplying apparatus.

FIG. 10*a* is a schematic top plan view showing a structure of a disk like shape type secondary electron multiplying apparatus 221 of a third preferred embodiment according to the present invention, and FIG. 10*b* is a schematic cross sectional view taken on a line Xb-Xb' of FIG. 10*a* of the disk like shape type secondary electron multiplying apparatus 221.

Referring to FIGS. 10*a* and 10*b*, the disk like shape type secondary electron multiplying apparatus 221 comprises a circular plate-shaped first channel base 222 for multiplying secondary electrons, a circular plate-shaped second channel base 223 for inducing an inclined electric field, and a ring-shaped collector electrode 224 arranged in the outer peripheral portions of the first and second channel bases 222 and 223 so that the inner surface of the collector electrode 224 opposes to the outer peripheral surfaces of the first and second channel bases 222 and 223.

Each of the first and second channel bases 222 and 223 is made of a material having a relatively large secondary electron emission coefficient so as to emit many secondary electrons when primary electrons bombard there, such as a ceramics semiconductor of $ZnO—TiO_2$ system.

The first and second channel bases 222 and 223 are arranged axially so as to oppose to each other, namely, so that the surfaces thereof become parallel to each other, and then, there is formed a channel 225 for moving secondary electrons in the radial direction between the first and second channel bases 222 and 223. The channel 225 has an entrance end 225*a* located between the peripheral edge of an incidence hole 226 of charged particles formed in the center of the second channel base 223 and a portion of the inner surface of the first channel base 222 opposing thereto, and an exit end 225*b* located between respective outer peripheral edges of the first and second channel bases 222 and 223.

A center electrode 227 is formed in the center of the inner surface of the first channel base 222, and an outer peripheral electrode 228 is formed on the inner surface of the first channel base 222 located in the vicinity of the outer peripheral edge thereof so as to extend from the outer peripheral surface thereof to the inside of the channel 225 toward the center thereof by a predetermined length. An incidence electrode 229 is formed on the inner surface of the incidence hole 226 formed in the center of the second channel base 223, and an outer peripheral electrode 231 is formed on the outer peripheral surface of the second channel base 223. It is to be noted that the collector electrode 224 is electrically insulated from the outer peripheral electrodes 228 and 231.

The inner surface 223*s* of the second channel base 223 opposing to the inner surface of the first channel base 222 is processed so as to be made rough, namely, so as to have a secondary electron emission coefficient smaller than that of inner surface of the first channel base 222. This process is performed for the following reason. Secondary electrons collide with a remaining gas on the side of the exit end 225*b* of the channel 225 where the density of the electrons becomes high because of multiplying the secondary electrons, and the remaining gas becomes ions having a polarity opposite to that of the secondary electrons. Then, these ions may go back into the channel 225, and bombard respective inner surfaces of the first and second channel bases 222 and 223 so as to emit secondary electrons. Namely, the ion feed back phenomenon is caused. In order to prevent the above-mentioned ion feed back phenomenon, the inner surface 223*s* of the second channel base 223 is processed as described above.

A direct-current high voltage source 232 is electrically connected between the center electrode 227 of the first channel base 222 and the outer peripheral electrode 228 thereof so that the electric potential of the outer peripheral electrode 228 is higher than that of the center electrode 227. Further, another direct-current high voltage source 233 is electrically connected between the electrode 229 formed on the incidence hole 226 of the second channel base 223 and the outer peripheral electrode 231 thereof so that the electric potential of the outer peripheral electrode 231 is higher than that of the electrode 229. It is to be noted that the output voltage of the direct-current high voltage source 232 is substantially equal to that of the direct-current high voltage source 233.

In order to capture secondary electrons going out from the exit end 225*b* of the channel 225, a direct-current voltage source 234 is electrically connected between the collector electrode 224 and the outer peripheral electrode 228 of the first channel base 222. Then, the multiplied secondary electrons are taken out from the collector electrode 224 through a coupling capacitor Cc.

In the secondary electron multiplying apparatus 221 constructed as described above, since each of the first and second channel bases 222 and 223 is made of an electrically resistive material, each of the first and second channel bases 222 and 223 continuously divide the applied direct-current high voltage in the radius direction thereof or the radiation direction thereof. As described above, the outer peripheral electrode 228 is formed on the inner surface of the first channel base 222 so as to extend from the outer peripheral edge of the first channel base 222 to an extending end 228*e* thereof located on the inside of the channel 225. Therefore, on the inner surface of the first channel base 222, the center of the first channel base 222 has the lowest electric potential, and the extending end 228*e* of the outer peripheral electrode 228 has the highest electric potential. Similarly, on the second channel base 223, the inner surface of the incidence hole 226 has the lowest electric potential, and the outer peripheral surface thereof has the highest electric potential.

Figure 1:
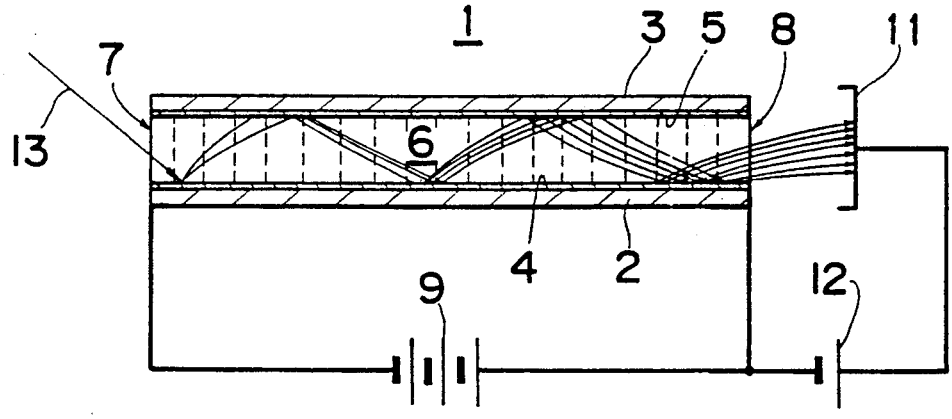
Fig. 1 PRIOR ART
FIG. 1 is a schematic cross sectional view showing a structure of a conventional secondary electron multiplying apparatus.
Figure 2:
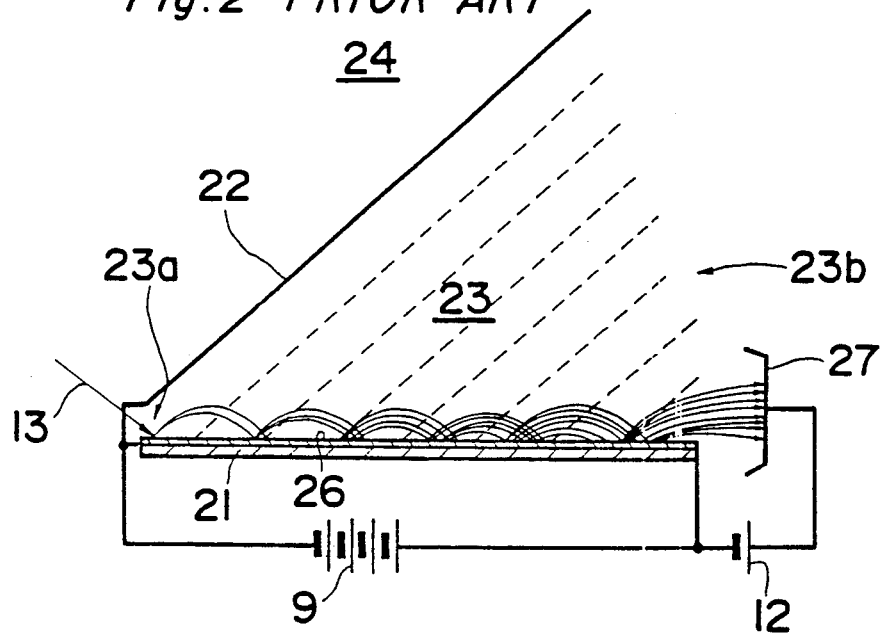
Fig. 2 PRIOR ART
FIG. 2 is a schematic cross sectional view showing a structure of another conventional secondary electron multiplying apparatus.
Figure 3:
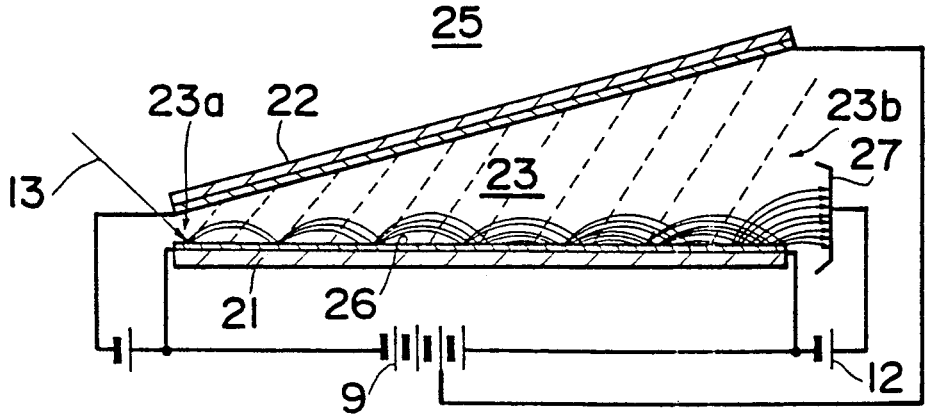
Fig. 3 PRIOR ART
FIG. 3 is a schematic cross sectional view showing a structure of a further conventional secondary electron multiplying apparatus.
Figure 4A:
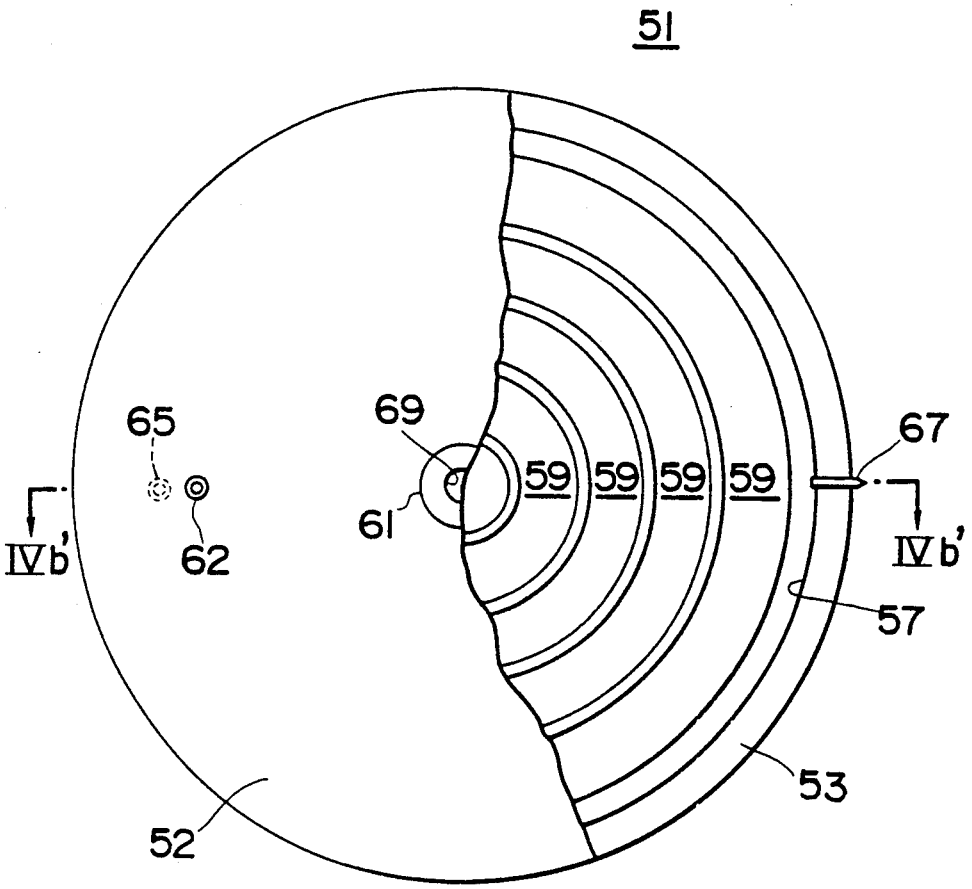
Fig.4a PRIOR ART
FIG. 4*a* is a schematic top plan view showing a structure of a conventional disk like shape type secondary electron multiplying apparatus.
Figure 4B:
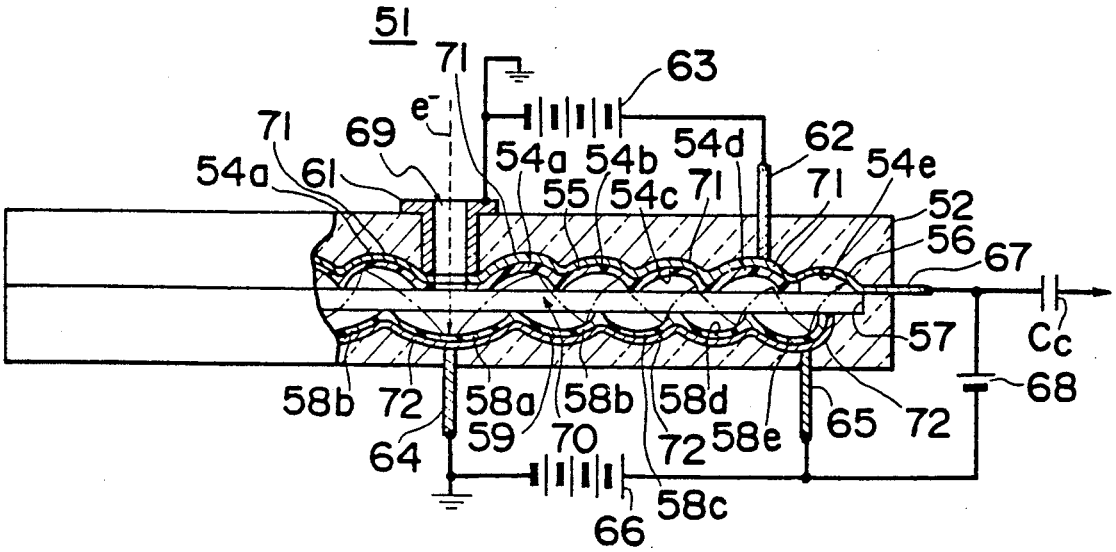
Fig.4b PRIOR ART
FIG. 4*b* is a schematic cross sectional view taken on a line IVb-IVb' of FIG. 4*a* of the disk like shape type secondary electron multiplying apparatus.

Accordingly, respective positions on the first channel base 222 having electric potentials equal to those of respective positions of the second channel base 223 are shifted toward the side of center thereof, and then, equipotential surfaces formed in the channel 225 is inclined as indicated by dotted lines in FIG. 10*b*. Therefore, there is induced an inclined electric field necessary for accelerating and multiplying secondary electrons emitted from the inner surface of the first channel base 222 when charged particles are incident into the channel 225 from the incidence hole 226 of the second channel base 223. Then, the whole inner surface of the first channel base 222 becomes a secondary electron multiplying surface, and the secondary electron multiplying surface is substantially larger than that of the conventional secondary electron multiplying apparatus 51 shown in FIGS. 4*a* and 4*b*. Accordingly, the efficiency upon multiplying secondary electrons becomes larger than that of the conventional secondary electron multiplying apparatus 51, and a larger output current can be obtained from the collector electrode 24.

Figure 11:
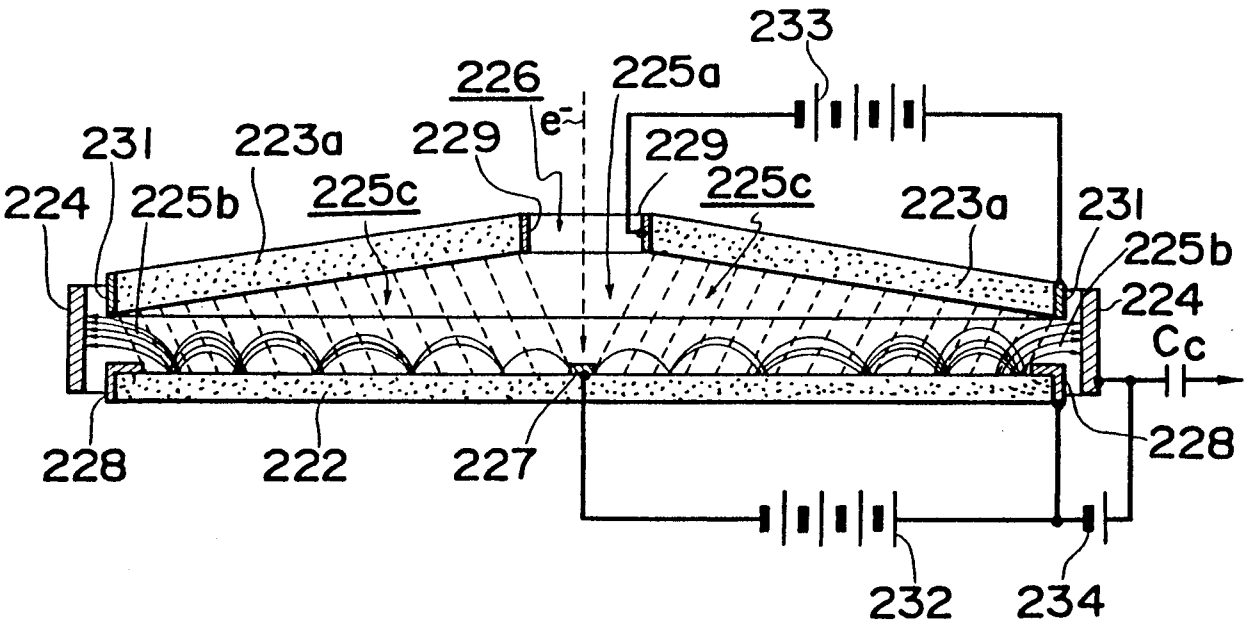
FIG. 11 is a schematic cross sectional view showing a structure of another disk like shape type secondary electron multiplying apparatus of a modification of the third preferred embodiment.

FIG. 11 is a schematic cross sectional view showing a structure of another disk like shape type secondary electron multiplying apparatus 241 of a modification of the third preferred embodiment. In FIG. 11, the components corresponding to those shown in FIGS. 10*a* and 10*b* are denoted by the same numerals as those shown in FIGS. 10*a* and 10*b*.

Referring to FIG. 11, as compared with the disk like shape type secondary electron multiplying apparatus 221 shown in FIGS. 10*a* and 10*b*, the disk like shape type secondary electron multiplying apparatus 241 is characterized in that the first and second channel bases 222 and 223*a* are arranged so that the interval between the first and second channel bases 222 and 223*a* becomes small as approaching from the entrance end 225*a* to the exit end 225*b*. Then, there is formed a channel 225*c* between the first and second channel bases 222 and 223*a*.

Since the second channel base 223*a* is inclined to the first channel base 222, equipotential surfaces connecting between the same electric potentials of the first and second channel bases 222 and 223*a* are inclined to the inner surface of the first channel base 222, as indicated by dotted lines in FIG. 11. Then, there is induced an inclined electric field necessary for accelerating and multiplying secondary electrons emitted when charged particles are incident onto the channel 225*c* from the incidence hole 226 formed in the center of the second channel base 223*a*. In this case, the interval between the first and second channel bases 222 and 223*a* in the center thereof is larger than that in the outer peripheral edges thereof.

In this case, in the secondary electron multiplying apparatus 241 of the modification shown in FIG. 11, a small hole (not shown) may be formed in the collector electrode 224. In this case, a beam of laser light emitted from a laser diode (not shown) is incident through the small hole of the collector electrode 224 into the channel 225*c* located between the first and second channel bases 222 and 223*a*, and on the other hand, various kinds of molecules and various kinds of atoms are incident into the channel 225*c* through the incidence hole 226 so as to make various kinds of reactions therebetween take place in the vicinity of the entrance end 225*a* of the channel 225*c*. Then, since the reaction space formed between respective centers of the first and second channel bases 222 and 223*a* is enlarged as described above, electrons and ions induced by the above-mentioned reaction can be incident into the channel 225*c*, and can be effectively multiplied without taking place the interference with the molecules and the atoms which have not reacted yet.

In this case, there is formed another hole (not shown) in the center of the first channel base 222 in order to exhaust the particles not having reacted yet through another hole to the outside of the channel 225*c*.

In the third preferred embodiment and the modification thereof, it is not necessary to set the diameters of the first and second channel bases 222 and 223 or 223*a* so that these diameters thereof are equal to each other. If necessary, in order to adjust the multiplying gain of the secondary electron multiplying apparatus, there may be adjusted the dimension of the secondary electron multiplying inner surface of the first channel base 222 by adjusting the dimensions of the outer peripheral electrodes 228 and 231 formed on the first and second channel 222 and 223 or 223*a*.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A secondary electron multiplying apparatus comprising:

a plate-shaped first channel base for multiplying secondary electrons having an entrance electrode formed on one end thereof and an exit electrode formed on another end thereof;

a plate-shaped second channel base for inducing an inclined electric field having an entrance electrode formed on one end thereof and an exit electrode formed on another end thereof, said second channel base being arranged so that an inner surface thereof opposes an inner surface of said first channel base, thereby forming a channel for moving said secondary electrons in a direction of said inclined electric field from an entrance end of said channel toward an exit end thereof;

said inner surface of said first channel base being made of an electrically resistive material having a predetermined relatively large secondary electron emission coefficient;

said inner surface of said second channel base being made of an electrically resistive material and having an Ar-ion-bombarded surface which is roughened due to such Ar ion bombardment, thereby decreasing a secondary electron emission coefficient thereof for preventing ion feedback due to ions generated by said secondary electrons near said exit end of said channel;

a collector electrode for collecting said multiplied secondary electrons going out from said channel, said collector electrode being arranged so as to oppose said exit end of said channel;

a first voltage source for applying a predetermined direct-current high voltage between said entrance electrodes of said first and second channel bases and said exit electrodes thereof; and a second voltage source for applying a predetermined direct-current voltage between said exit electrodes of said first and second channel bases and said collector electrode.

2. The apparatus as claimed in claim 1, wherein said second channel base is arranged so as to be shifted toward said exit end of said first channel base in a longitudinal direction thereof, thereby inducing said electric field inclined to said inner surface of said first channel base in said channel.

3. The apparatus as claimed in claim 1, wherein said first and second channel bases are arranged so that respective entrance ends thereof oppose to each other and respective exit ends thereof oppose to each other, said entrance electrode of said first channel base is formed on said inner surface thereof so as to extend from the edge thereof to the inside thereof in said longitudinal direction, and said exit electrode of said second channel base is formed on said inner surface thereof so as to extend from the edge thereof to the inside thereof in said longitudinal direction, thereby inducing said electric field inclined to said inner surface of said first channel base.

4. A secondary electron multiplying apparatus comprising:

a plate-shaped first channel base for multiplying secondary electrons having an entrance electrode formed on one end thereof and an exit electrode formed on another end thereof;

a plate-shaped second channel base for inducing an inclined electric field having an entrance electrode formed on one end thereof and an exit electrode formed on another end thereof, said second channel base being arranged so that an inner surface thereof opposes an inner surface of said first channel base and the interval between respective first ends of said first and second channel bases is larger than that between respective second ends thereof, thereby forming a channel for moving said secondary electrons in a direction of said inclined electric field from an entrance end of said channel toward an exit end thereof;

said inner surface of said first channel base being made of an electrically resistive material having a predetermined relatively large secondary electron emission coefficient;

said inner surface of said second channel base being made of an electrically resistive material and having an Ar-ion-bombarded surface which is roughened due to such Ar ion bombardment, thereby for decreasing a secondary electron emission coefficient thereof for preventing ion feedback due to ions generated by said secondary electrons near said exit end of said channel a collector electrode for collecting said multiplied secondary electrons going out from said channel, said collector electrode being arranged so as to oppose said exit end of said channel;

a first voltage source for applying a predetermined direct-current high voltage between said entrance electrodes of said first and second channel bases and said exit electrodes thereof; and a second voltage source for applying a predetermined direct-current voltage between said exit electrodes of said first and second channel bases and said collector electrode, thereby inducing said electric field inclined to said inner surface of said first channel base.

5. The apparatus as claimed in claim 4, wherein said second channel base is arranges so as to be shifted toward said exit end of said first channel base in a longitudinal direction thereof.

6. The apparatus as claimed in claim 4, wherein said first and second channel bases are arranged so that respective entrance ends thereof oppose to each other and respective exit end thereof oppose to each other, said entrance electrode of said first channel base is formed on said inner surface thereof so as to extend from the edge thereof to the inside thereof in said longitudinal direction, and said exit electrode of said second channel base is formed on said inner surface thereof so as to extend from the edge thereof to the inside thereof in said longitudinal direction, thereby inducing said electric field inclined to said inner surface of said first channel base.

7. The apparatus as claimed in claim 4, wherein said second channel base is folded so that the interval between respective one ends of said first and second channel bases is larger than that between respective another ends thereof.

8. A secondary electron multiplying apparatus comprising:

a circular plate-shaped first channel base for multiplying secondary electrons having an entrance electrode formed in the center thereof and an exit electrode formed on the outer peripheral edge thereof so as to extend toward said entrance electrode by a predetermined longitudinal length;

a circular plate-shaped second channel base for inducing an inclined electric field having an incidence hole for passing primary electrons therethrough which is formed in the center thereof, an entrance electrode formed on the inner surface of said incidence hole and an exit electrode formed on the outer peripheral surface thereof, said second channel base being arranged so that an inner surface thereof opposes an inner surface of said first channel base, thereby forming a channel for moving said secondary electrons in a direction of said inclined electric field from an entrance area near the center of said channel toward an exit area near the outer peripheral portion thereof;

said inner surface of said first channel base being made of an electrically resistive material having a predetermined relatively large secondary electron emission coefficient;

said inner surface of said second channel base being made of an electrically resistive material and having an Ar-ion-bombarded surface which is roughened due to such Ar ion bombardment, thereby for decreasing a secondary electron emission coefficient thereof for preventing ion feedback due to ions generated by said secondary electrons near said exit end of said channel;

a collector electrode for collecting said multiplied secondary electrons going out from said channel, said collector electrode being arranged so as oppose to said exit outer peripheral portion of said channel;

a first voltage source for applying a predetermined direct-current high voltage between said entrance electrode of said first channel base and said exit electrode thereof;

a second voltage source for applying a predetermined direct-current high voltage between said entrance electrode of said second channel base and said exit electrode thereof; and a third voltage source for applying a predetermined direct-current voltage between said exit electrode of said first channel base and said collector electrode, thereby inducing said electric field inclined to said inner surface of said first channel base.

9. The apparatus as claimed in claim 8, wherein the interval between respective centers of said first and second channel bases is larger than that between respective outer peripheral edges thereof.

* * * * *